US006299142B1

(12) United States Patent
Chaney et al.

(10) Patent No.: US 6,299,142 B1
(45) Date of Patent: Oct. 9, 2001

(54) POST AND RAILING SYSTEM

(75) Inventors: Michael T. Chaney, Middletown; Jonathan C. Hauberg, Beavercreek; Paul A. Siudzinski, Springboro, all of OH (US)

(73) Assignee: Dayton Technologies, L.L.C., Monroe, OH (US)

( * ) Notice: Subject to any disclaimer, the term of this patent is extended or adjusted under 35 U.S.C. 154(b) by 0 days.

(21) Appl. No.: 09/406,191

(22) Filed: Sep. 27, 1999

(51) Int. Cl.[7] ..... E04H 17/14
(52) U.S. Cl. ..... 256/65; 256/19
(58) Field of Search ..... 256/65, 66, 19, 256/50; 403/251, 192, 263

(56) References Cited

U.S. PATENT DOCUMENTS

| | | | | |
|---|---|---|---|---|
| 3,822,053 | * | 7/1974 | Daily | 256/22 |
| 4,107,767 | * | 8/1978 | Anquetin | 362/236 |
| 4,389,134 | * | 6/1983 | Colas | 403/263 |
| 4,439,818 | * | 3/1984 | Scheib | 362/250 |
| 4,540,160 | | 9/1985 | Zanavich et al. . | |
| 4,722,514 | | 2/1988 | Pettit . | |
| 4,809,955 | | 3/1989 | Veilleux . | |
| 4,892,434 | * | 1/1990 | Miller | 403/361 |
| 5,161,783 | | 11/1992 | German . | |
| 5,581,868 | * | 12/1996 | Bisch | 29/525.08 |
| 5,601,278 | * | 2/1997 | Graber | 256/66 |
| 5,651,534 | | 7/1997 | Yoder . | |
| 6,017,019 | * | 1/2000 | Erwin | 256/65 |
| 6,131,888 | * | 10/2000 | Brown | 256/65 |

* cited by examiner

*Primary Examiner*—Lynne H. Browne
*Assistant Examiner*—John B. Walsh
(74) *Attorney, Agent, or Firm*—Jacox, Meckstroth & Jenkins

(57) ABSTRACT

Horizontally spaced vertical posts each include a square tubular extruded plastic sleeve enclosing a square tubular metal reinforcing post having a lower end portion with keyhole and vertical slots in each side for receiving bolts preassembled to a supporting frame or substructure. Upper and lower elongated rails each include a tubular extruded plastic body enclosing a metal reinforcing channel and also define a longitudinally extending open cavity. Opposite end portions of the rails project into corresponding openings within the posts, and an elongated extruded plastic cap has longitudinal snap clips engaging opposing lips projecting into the cavity within the upper rail. A plurality of plastic vertical spindles have upper and lower end portions projecting into the bodies and channels of the upper and lower rails, and the end portions of the rail bodies have outwardly projecting retaining barbs within the posts. Each metal reinforcing post has outwardly and downwardly projecting barbs which secure the corresponding plastic sleeve, and the downwardly facing cavity within the lower rail body is adapted to receive a lighting strip.

17 Claims, 4 Drawing Sheets

21
10
80
3
12
62
55
105
18
58
8
51
16
43
26
39
14
41
82
83
68
64
36
31
28
34
46
47

POST AND RAILING SYSTEM

BACKGROUND OF THE INVENTION

The present invention relates to plastic post and railing systems which use components of extruded rigid plastics materials and of the general type disclosed in U.S. Pat. Nos. 4,540,160, 4,722,514, 4,809,955, 5,161,783 and 5,651,534. In any such system, it is desirable for the vertical posts and the horizontal rails to provide high strength and durability in addition to a clean and neat appearance with no maintenance. It is also desirable for the system to be designed for rapid and convenient installation with a minimum number of components and fasteners while also using economically produced components. While some of these features are provided by some of the systems disclosed in the above patents, none of the systems provide all of the desirable features.

SUMMARY OF THE INVENTION

The present invention is directed to an improved post and railing system which provides all of the desirable features and advantages mentioned above including high strength and durability with no maintenance, easy and rapid assembly and a clean and neat appearance which may be easily modified. In accordance with a preferred embodiment of the invention, a series of horizontally spaced vertical posts each has a square extruded plastic outer sleeve which slides over a tubular metal square reinforcing post having outwardly and downwardly projecting tabs or barbs for positively securing the outer sleeve. The lower end portion of each metal reinforcing post has a keyhole slot and a bottom vertical slot within each side wall for receiving and securing threaded fasteners preassembled to a supporting frame.

Upper and lower rails extend between two posts, and each rail includes an extruded plastic tubular body which also defines a longitudinal extending open cavity. A U-shaped steel reinforcing channel extends within the tubular body of the lower rail, and a similar inverted U-shaped channel extends within the body of the upper rail. The opposite end portions of each rail body and its enclosed reinforcing channel extend into corresponding openings within the vertical posts, and a series of horizontally spaced vertical spindles have upper and lower end portions which project into the corresponding plastic rail bodies and metal reinforcing channels. The upwardly facing cavity within the upper rail body is covered by an extruded plastic rail cap which extends between the sleeves of the two posts and has longitudinally extending snap clips which engage opposing flanges or lips at the top of the cavity. The downwardly facing cavity within the lower rail body is adapted to receive an optional lighting strip. Opposite end portions of the upper and lower rail bodies have outwardly projecting tabs or barbs which snap-fit into the post sleeves and retain the end portions of the rails within the posts.

Other features and advantages of the invention will be apparent from the following description, the accompanying drawings and the appended claims.

DESCRIPTION OF THE PREFERRED EMBODIMENT

Figures 1, 2:
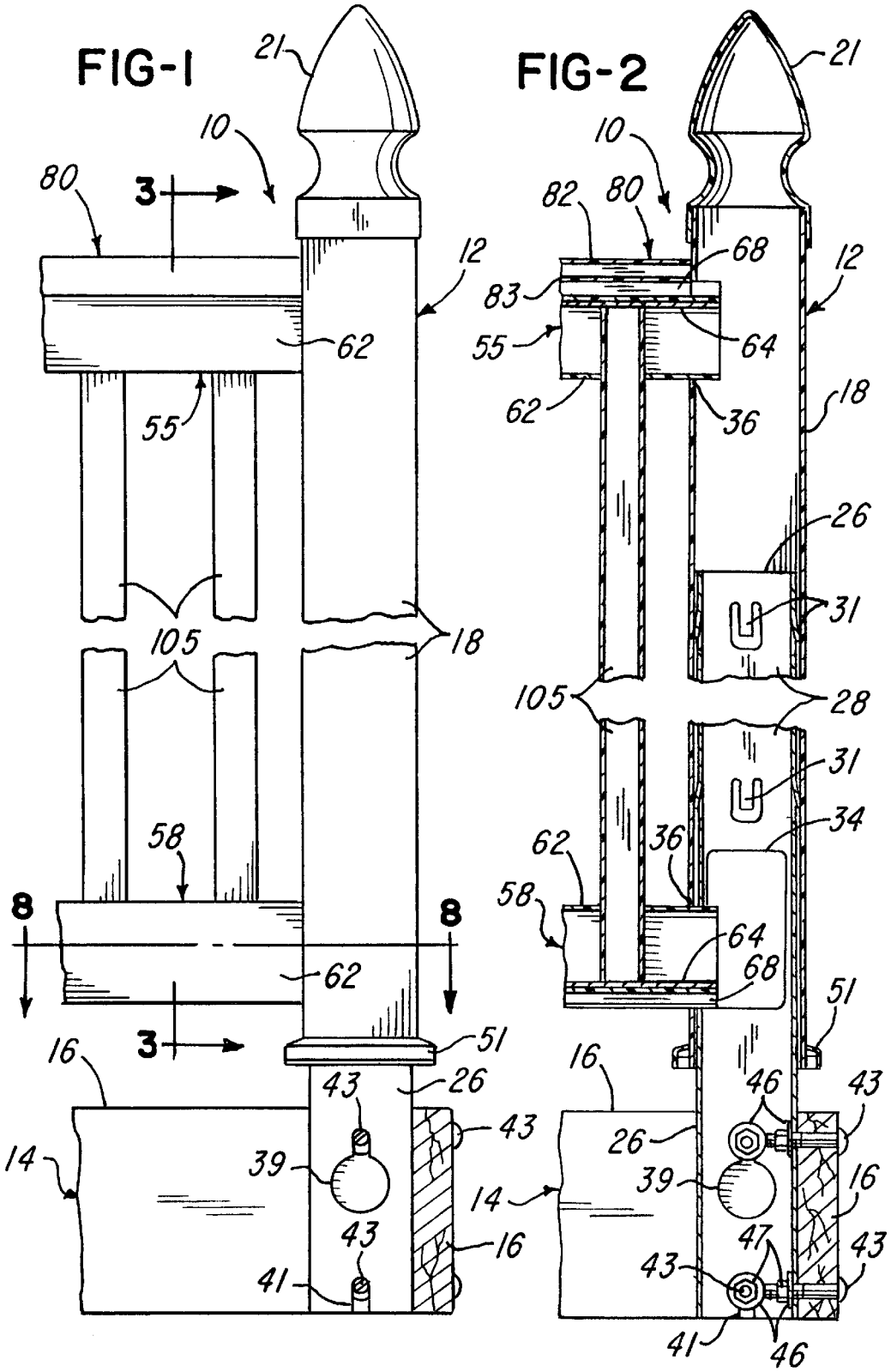
FIG. 1 is a fragmentary elevational view of a post and railing system constructed in accordance with the invention.
FIG. 2 is a fragmentary vertical section of the post and railing system shown in FIG. 1 and taken generally on the line 2—2 of FIG. 8.
Figure 6:
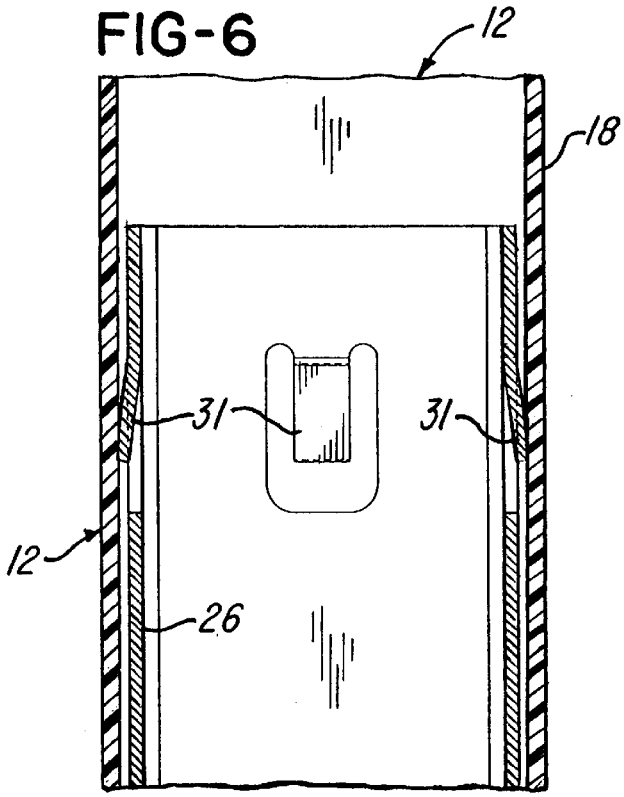
FIG. 6 is an enlarged fragmentary section of the post shown in FIG. 2.
Figure 7:
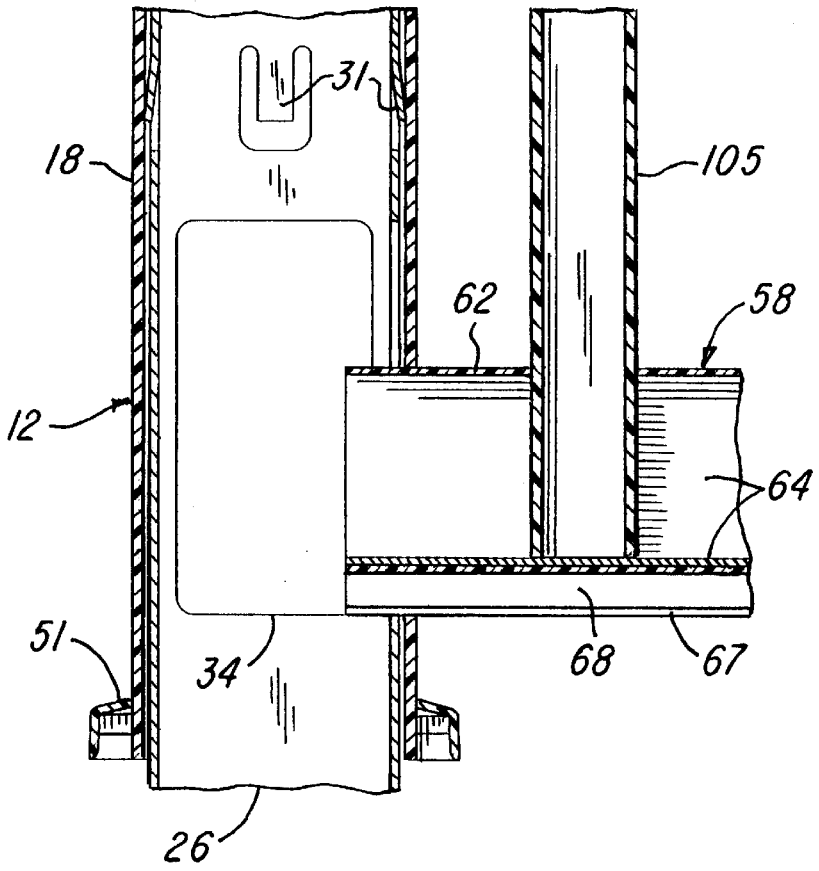
FIG. 7 is an enlarged fragmentary section of a post and bottom rail, taken generally on the line 7—7 of FIG. 8.

FIG. 1 illustrates a plastic post and railing system 10 which includes a plurality or series of spaced vertical posts 12 supported by a substructure or frame 14 shown in the form of a wood deck frame having peripherally extending wood joists or frame members 16. Each of the posts 12 includes a square outer body or sleeve 18 (FIG. 2) which is preferably extruded of a rigid plastics material such as polyvinylchloride (PVC). The sleeve 18 of each post is covered by a post cap 21 which is preferably molded of a plastics material such as PVC and is secured to the sleeve 18 by a structural adhesive 23. Each post 12 also includes an internal square reinforcing post or tube 26 which is preferably constructed of tubular metal such as aluminum or welded steel tubing. Each tubular reinforcing post 26 has an upper portion 28 with each side wall having a pair of vertically spaced integral tabs or barbs 31 which project outwardly and downwardly, as shown in FIGS. 6 & 7, for positively retaining the sleeve 18 after the sleeve is pressed downwardly onto the reinforcing tube 26.

Figure 4:
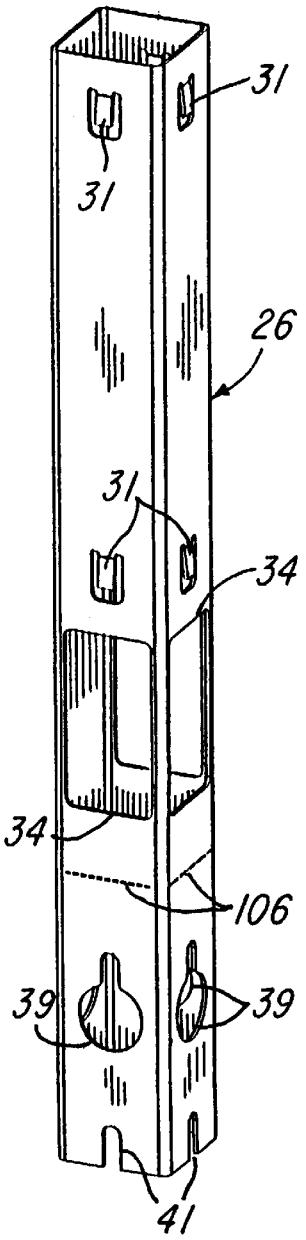
FIG. 4 is a perspective view of the metal reinforcing post shown in section in FIG. 2.
Figure 5:
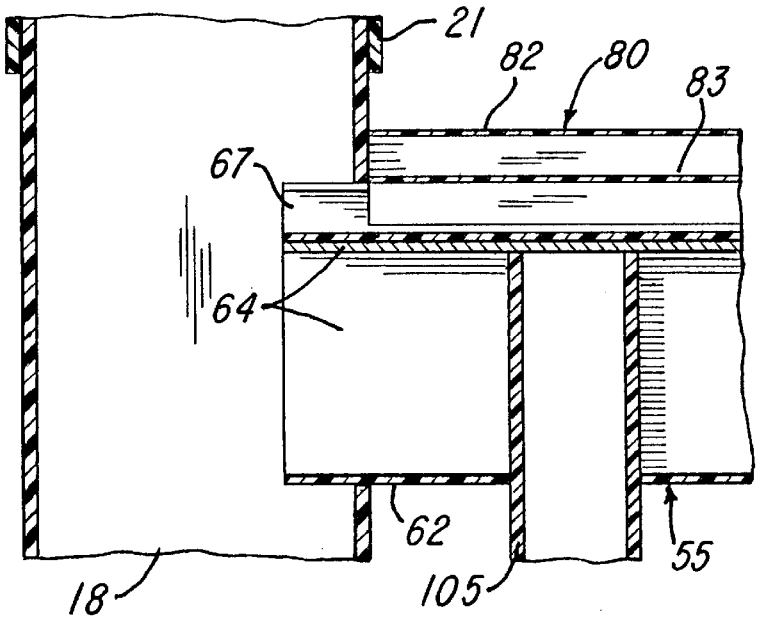
FIG. 5 is an enlarged fragmentary section of a post and upper rail, taken generally on the line 5—5 of FIG. 3.

Referring to FIG. 4, three of the side walls of each reinforcing post 26 have rectangular holes or openings 34 which align with one or more corresponding slots 36 formed within the surrounding sleeve 18. Each of the four side walls of each metal reinforcing post or tube 26 also has a keyhole slot 39 and a bottom vertical slot 41 within the lower end portion of the tube, as shown in FIGS. 2 and 4. The slots 39 and 41 are spaced to receive a pair of vertically spaced bolts 43 which are preassembled within the frame members or joists 16 of the supporting frame 14, as shown in FIG. 2. A washer 46 and nut 47 are preassembled on each bolt 43, and while the washers 46 and nuts 47 are loose, the reinforcing post 26 is mounted on the bolts 43 and then shifted downwardly to the position shown in FIG. 2.

Figure 3:
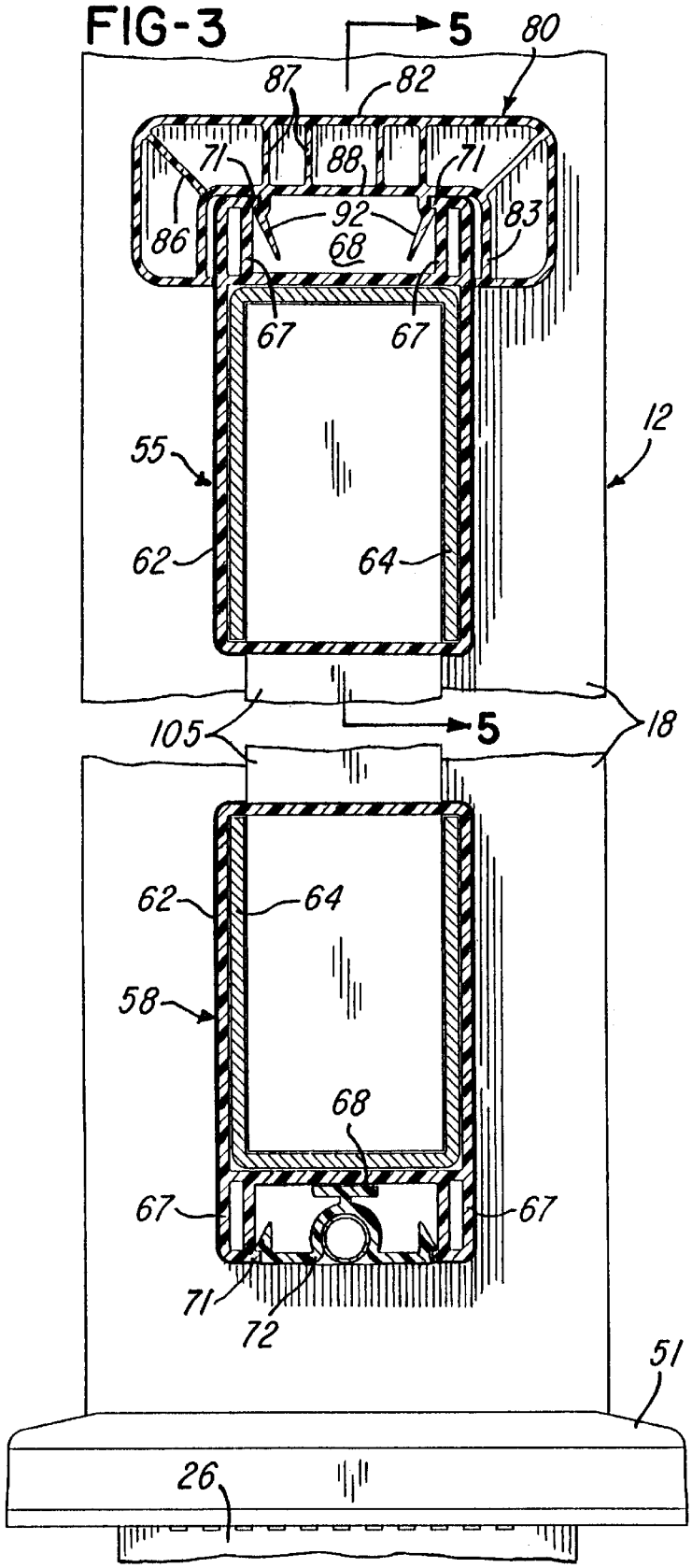
FIG. 3 is an enlarged vertical section through the rails, taken generally on the line 3—3 of FIG. 1.

After each post 26 is installed on its corresponding bolts 43, the nuts 47 are tightened with the aid of a socket wrench extending through the keyhole slot 39 on the opposite side wall of the post and through the open bottom end of the post. Referring to FIGS. 1–3, a square annular base collar 51 is mounted on the sleeve 18 of each post 14 and is adapted to engage the planks (not shown) forming a deck mounted on the supporting substructure or supporting frame 14.

An elongated upper rail 55 and a parallel spaced lower rail 58 extend between each pair of adjacent posts 12, and each rail includes a tubular plastic sleeve or body 62 (FIG. 3) having a rectangular cross-sectional configuration and defining a closed chamber for receiving an aluminum or steel reinforcing channel 64. As shown in FIG. 3, the reinforcing channel 64 within the body 62 of the lower rail 58 has a U-shaped cross-sectional configuration, and the channel 64 within the body 62 of the upper rail 55 has an inverted U-shaped cross-sectional configuration. The body 62 of each rail is formed of an extruded rigid plastics material or PVC, and each body 62 has a pair of longitudinally extending double wall flanges 67 (FIG. 3) which define a longitudinally extending recess or cavity 68. Opposing flanges or lips 71 are integrally extruded with the double wall flanges 67 and project inwardly at the top of the cavity 68.

Figure 8:
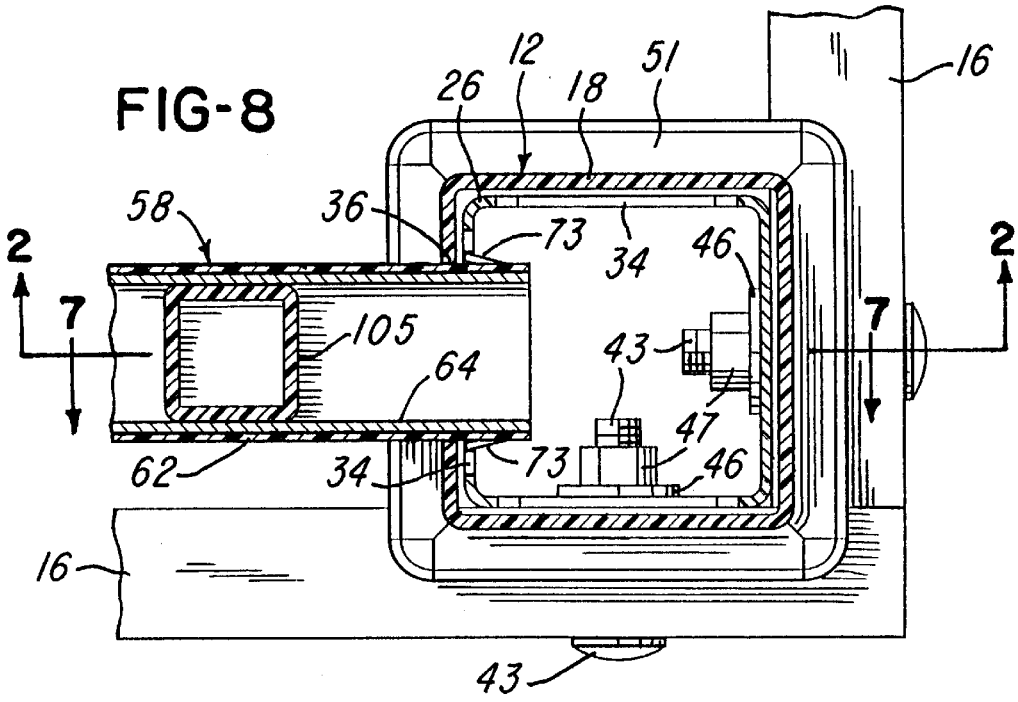
FIG. 8 is a fragmentary section of a post and bottom rail, taken generally on the line 8—8 of FIG. 1.

As also shown in FIG. 3, the body 62 of the lower rail 58 is positioned so that the cavity 68 faces downwardly and is out of sight. The downwardly facing cavity 68 is adapted to receive an optional snapin lighting strip 72 which retains a snap-in transparent tube enclosing longitudinally spaced small electrical light bulbs or elements. The body 62 of the upper rail 55 is positioned so that the cavity 68 faces upwardly. As shown in FIG. 8, the opposite end portions of the rails 55 and 58, including the tubular bodies and internal reinforcing channels 64, extend into the corresponding tubular posts 12 through the corresponding rectangular holes or openings 36 within the sleeves 18. The lower rails 58 also extend through the corresponding holes or openings 34 within the metal reinforcing tubes or posts 26.

The holes 34 within the metal reinforcing posts 26 are larger than the holes 36 within the sleeves 18 to provide for adjusting the height of the lower rail 58 and for accommodating inclined rails when the railing system is used on a stairway. The opposite end portions of each rail body 62 has outwardly projecting tapered locking tabs or barbs 73 (FIG. 8) which are cammed inwardly when the end portion of each rail body 62 is inserted into its corresponding opening 36 and snap outwardly to a locking position (FIG. 8) after the barbs 73 clear the holes 36. The barbs 73 thereby lock the opposite end portions of each upper and lower rail to the corresponding supporting post 12.

Referring to FIG. 3, the upper rail 55 includes a rail cap 80 which is extruded of a rigid plastics material or PVC. The cap 80 has an outer C-shaped wall 82 and an inner inverted U-shaped wall 83 which are integrally connected and reinforced by internal walls 86 and 87. The inner wall 83 defines a downwardly facing cavity 88 which receives the upwardly projecting double wall flanges 67 of the upper rail body 62. The rail cap 80 is extruded with a pair of longitudinally extending snap clips 92 which project downwardly into the cavity 88 of the cap 80. The upper rail cap 80 extends between the sleeves 18 of the two adjacent posts 12 and is assembled onto the upper rail 55 by simply pressing the rail cap 80 downwardly onto the rail body 62 until the snap clips 92 engage the opposing flanges or lips 71 on the rail body 62.

A series of parallel spaced vertical spindles 105 are each formed from a section of an extruded rigid plastics material or PVC, and each spindle 105 is shown with a square cross-sectional configuration. However, the spindles 105 may have other configurations. As shown in FIGS. 2 and 3, the upper and lower end portions of each spindle 105 extend through mating holes formed or routered within the tubular bodies 62 of the upper and lower end rails and into the corresponding rail reinforcing channels 64. Thus the reinforcing channels 64 not only strengthen and reinforce the upper and lower rails, but also strengthen and reinforce the spindles 105, especially against laterally applied forces. Preferably, the reinforcing channels 64 are formed of aluminum or galvanized sheet steel to avoid corrosion.

The assembly of the post and railing system described above on a deck frame is commenced by installing the tubular metal reinforcing posts 26 onto the frame 14 with a reference line 106 (FIG. 4) on each post 26 at a level corresponding to the top of the deck planks (not shown). A tubular sleeve 18 is then pressed onto each post 26, after which the collar 51 is mounted on the sleeve. Each lower rail 58 is then installed by sliding one end portion of the rail into an opening 36 until the opposite end of the rail clears its supporting post and is aligned with its corresponding opening 36. The lower rail 58 is then shifted longitudinally in the opposite direction to insert the opposite end portion of the rail into the hole 36 within the corresponding post 12. After the spindles 105 are inserted into the lower rail 58, the upper rail 55 is installed on the upper end portions of the spindles 105 while the spindles 105 are flexed laterally so that the upper rail 55 is positioned laterally of the two posts 12. The upper rail 55 is then moved longitudinally by a short distance, causing the spindles 105 to rack slightly until one end of the upper rail 55 is inserted into its corresponding opening 36 within a post sleeve 18. The upper rail 55 is then shifted longitudinally to rack the spindles 105 in the opposite direction until the opposite end of the rail is aligned with its corresponding opening 36. The upper rail 55 is then shifted longitudinally in the opposite direction until the opposite end of the rail 55 engages the corresponding post, as shown in FIG. 8. The rail cap 80 is then attached to the upper rail body 62, as described above and shown in FIG. 3.

From the drawings and the above description, it is apparent that a post and railing system constructed in accordance with the present invention, provides desirable features and advantages. For example, the construction of the metal reinforcing post 26, including the barbs 31 and slots 39 and 41 provide for convenient and rapid assembly of each post 12 to the supporting substructure or frame 14. As another advantage, the construction of the upper rail 55 and lower rail 58, including the common extruded plastic body 62, provides for not only receiving the common reinforcing channel 64, but also for quickly and conveniently attaching the snap-on rail cap 80 which may have different cross-sectional configurations. The downwardly facing cavity 68 within the lower rail body 62 also provides for receiving a lighting strip if it is desired to light the peripheral or edge portion of a deck or walkway. The post and railing system of the invention further provides for high strength and durability, and minimizes maintenance and eliminates the use of separate fasteners for assembling the post, sleeves, rails and spindles. The post and railing system is ideal for use with wood decks, boardwalks, sidewalks, porches or steps, and it is apparent that the lower end portions of the tubular reinforcing posts 26 may be inserted into concrete when the post and railing system is used with a concrete walkway, steps or patio.

While the form of post and railing herein described constitutes a preferred embodiment of the invention, it is to be understood that the invention is not limited to this precise form, and that changes may be made therein without departing from the scope and spirit of the invention as defined in the appended claims.

What is claimed is:

1. A post and railing system for use with a supporting substructure, comprising at least two horizontally spaced vertical posts each including a tubular sleeve of rigid plastics material, an elongated upper rail and a parallel spaced elongated lower rail each having a tubular body of rigid plastics material, each of said upper and lower rails having opposite end portions projecting into corresponding holes within said sleeves of said posts, a plurality of parallel spaced vertical spindles of rigid plastics material and having upper and lower end portions projecting into said tubular bodies of said upper and lower rails, each of said posts including a metal reinforcing tube having an upper portion projecting into the corresponding said tubular sleeve, and said upper portion of each said metal reinforcing tube having downwardly and outwardly projecting barbs engaging the corresponding said tubular sleeve of said post for securing said sleeve to said upper portion of said reinforcing tube.

2. A system as defined in claim 1 wherein said lower portion of each said metal reinforcing tube comprises a plurality of keyhole slots adapted for receiving threaded fasteners secured to a frame forming the supporting substructure.

3. A system as defined in claim 1 wherein each said reinforcing tube has side walls each having a keyhole slot spaced above a vertical slot extending to a bottom surface of said reinforcing tube.

4. A post and railing system for use with a supporting substructure, comprising at least two horizontally spaced vertical posts each including a tubular body of rigid plastics material, an elongated upper horizontal rail and a parallel spaced elongated lower horizontal rail each having a tubular body of rigid plastics material, each of said upper and lower rails having opposite end portions projecting into corresponding holes within said bodies of said posts, a plurality of parallel spaced vertical spindles of rigid plastics material and having upper and lower end portions projecting into said tubular bodies of said upper and lower rails, said body of said upper rail defining a longitudinally extending and upwardly facing cavity extending horizontally the length of said upper rail, an elongated and horizontally extending rail cap of rigid plastics material and covering said cavity within said upper rail, and a snap connection between said rail cap and said body of said upper rail.

5. A system as defined in claim 4 wherein said body of said upper rail includes a pair of parallel spaced upwardly projecting flanges defining said longitudinally extending open top cavity, and said rail cap includes longitudinally extending snap clips projecting downwardly into said cavity and engaging said flanges to form said snap connection.

6. A system as defined in claim 4 wherein each of said posts includes a metal reinforcing tube having an upper portion projecting into the corresponding said tubular body, each said reinforcing tube having a hole for receiving said lower rail, and each said reinforcing tube including a lower portion having holes for receiving fasteners to secure said post to the substructure.

7. A system as defined in claim 6 wherein said upper portion of each said metal reinforcing tube includes downwardly and outwardly projecting barbs engaging the corresponding said tubular body of said post for securing said body of said post to said upper portion of said reinforcing tube.

8. A system as defined in claim 6 wherein said holes within said lower portion of each said metal reinforcing tube comprise a plurality of keyhole slots adapted for receiving threaded fasteners secured to a frame forming the supporting substructure.

9. A system as defined in claim 6 wherein each of said metal reinforcing tubes has four side walls and is generally square in horizontal cross-section, and each of said side walls has one of said holes for receiving a lower rail.

10. A system as defined in claim 6 wherein each said reinforcing tube has side walls with a plurality of vertically spaced and downwardly and outwardly projecting barbs to engage said tubular body of the corresponding said post, and a plurality of said side walls of each said reinforcing tube each has a keyhole slot spaced above a vertical slot extending to a bottom surface of said reinforcing tube.

11. A system as defined in claim 4 wherein said body of said lower rail defines a longitudinally extending and downwardly facing cavity, and an electrical lighting strip extends within said cavity.

12. A system as defined in claim 4 and including a U-shaped metal reinforcing channel extending longitudinally within said body of said lower rail and an inverted U-shaped metal reinforcing channel extending longitudinally within said body of said upper rail, said end portions of said spindles extending into the corresponding said reinforcing channels, and each of said reinforcing channels having opposite end portions projecting into corresponding said holes within said post.

13. A system as defined in claim 4 wherein said body of said lower rail defines a longitudinally extending and downwardly facing cavity extending horizontally the length of said lower rail, and said tubular bodies of said upper and lower rails have generally the same cross-sectional configuration.

14. A post and railing system for use with a supporting substructure, comprising at least two horizontally spaced vertical posts each including a tubular body of rigid plastics material, an elongated upper rail and a parallel spaced elongated lower rail each having a tubular body of rigid plastics material, each of said upper and lower rails having opposite end portions projecting into corresponding holes within said bodies of said posts, a plurality of parallel spaced vertical spindles of rigid plastics material and having upper and lower end portions projecting into said tubular bodies of said upper and lower rails, each of said posts including a rigid reinforcing tube having an upper portion projecting into the corresponding said tubular body, each said reinforcing tube having a hole for receiving said lower rail, and each said reinforcing tube including a lower portion having a plurality of keyhole slots for receiving fasteners to secure said post to the substructure.

15. A system as defined in claim 14 and including a U-shaped metal reinforcing channel extending longitudinally within said body of said lower rail and an inverted U-shaped metal reinforcing channel extending longitudinally within said body of said upper rail, said end portions of said spindles extending into the corresponding said reinforcing channels, and each of said reinforcing channels having opposite end portions projecting into corresponding said holes within said post.

16. A system as defined in claim 14 wherein said body of said upper rail includes a pair of parallel spaced upwardly projecting flanges defining a longitudinally extending cavity, and an elongated horizontal rail cap having longitudinally extending snap clips projecting downwardly into said cavity and engaging said flanges to form a snap connection.

17. A system as defined in claim 14 wherein said upper portion of each said metal reinforcing tube includes downwardly and outwardly projecting barbs engaging the corresponding said tubular body of said post for securing said body to said upper portion of said reinforcing tube.

* * * * *